United States Patent [19]

Koch et al.

[11] 3,951,416

[45] Apr. 20, 1976

[54] GOLF TRAINING DEVICE

[75] Inventors: Karl W. Koch, Manhasset, N.Y.; J. Joseph Sherry, Jackson, N.J.

[73] Assignee: Koch-Sherry Inc., Great Neck, N.Y.

[22] Filed: Jan. 13, 1975

[21] Appl. No.: 540,432

[52] U.S. Cl. ..... 273/183 B; 273/183 D; 273/189 R; 273/166; 273/191 R

[51] Int. Cl.[2] ..... A63B 69/36

[58] Field of Search ..... 273/166, 188, 183, 189, 273/190, 191 R, 26 C, 29 A

[56] References Cited

UNITED STATES PATENTS

| | | | |
|---|---|---|---|
| 1,530,519 | 3/1925 | Remington | 273/188 R |
| 1,690,312 | 11/1928 | Rosan | 273/166 |
| 2,273,416 | 2/1942 | Norwood | 273/166 |
| 2,319,390 | 5/1943 | Dantolan | 273/166 |
| 2,476,489 | 7/1949 | Grandinetti | 273/166 |
| 2,496,808 | 2/1950 | Moore | 273/166 |
| 3,339,926 | 9/1967 | Coupar | 273/183 B |
| 3,684,294 | 8/1972 | Champion | 273/183 D |

*Primary Examiner*—George J. Marlo

*Attorney, Agent, or Firm*—Morgan, Finnegan, Pine, Foley & Lee

[57] ABSTRACT

An integral lightweight device has a clamp portion, which engages the grip of a golf club adjacent the end of the club, and a laterally spaced forearm clamp portion to receive the golfer's trailing arm. The unit maintains a fixed triangular relationship defined by the golfer's arm, club grip and the device. This triangular relationship prevents breaking of the trailing arm wrist on short swings, particularly putting. The device can include indicia cooperable with indicia on the upper end of the club handle for aligning the club head with the path of the swing.

12 Claims, 5 Drawing Figures

GOLF TRAINING DEVICE

This invention relates to training devices for teaching golfers to swing properly and more particular to the prevention of breaking the golfer's trailing arm and both wrists during short swings, particularly putting.

PRIOR ART

With the ever increasing popularity of outdoor sports and golfing in particular, efforts have been made to provide teaching devices so that the beginner may more quickly develop his skill and thus provide for more enjoyment of the game.

The teaching devices disclosed in the prior art have drawbacks. Among other things many of the prior art devices are awkward and do not facilitate proper alignment of the club to the ball. Further, the devices permit breaking of a player's trailing wrist in putting and on short swings, and do not maintain the requisite angle between the center line of the golf shaft and trailing arm throughout the swing.

SUMMARY OF THE INVENTION

The teaching device of the present invention is an integral, light weight unit designed to teach proper arm positioning for short swing shots, particularly putting. The device includes a club clamp portion which resiliently engages the club grip adjacent the end of the club and a rigidly spaced arm bracket which is resiliently engaged with the forearm portion of the golfer's trailing arm above the wrist. The device thus forces the golfer's trailing arm to assume a predetermined angular relationship with the center line of the putter without any manual manipulation which might inhibit the golfer's swing during use and instill a grip orientation inconsistent with the golfer's swing when not using the device.

To facilitate alignment of the club head to the ball, the club clamp and arm bracket are sloped downwardly toward each other, and preferably, the club clamp is turned inwardly relative to the club bracket. In preferred embodiment the clamp and bracket are each positioned at about a five degree angle to the vertical axis of the device and the clamp is turned inwardly at about a five degree angle relative to its horizontal axis.

The device also includes indicia which is aligned with cooperating indicia on the club to facilitate alignment of the club head in perpendicular relationship with the golfer's swing.

The combination of the triangulation of the trailing arm and alignment of the putter head thus cooperate to teach proper swing without pushing or pulling and prevent the golfer's wrists from breaking during his swing.

DETAILED DESCRIPTION OF A PREFERRED EMBODIMENT

Figure 1:
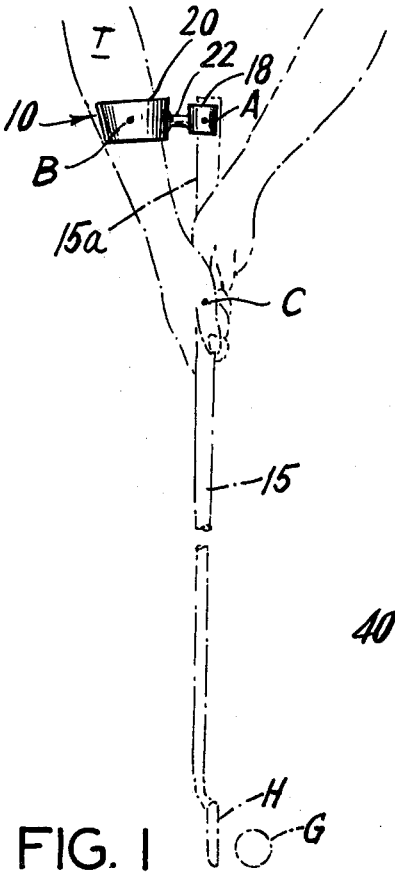
FIG. 1 is a front elevation view showing a device in accordance with the present invention secured to the forearm of a golfer and a putter to establish proper triangulation.
Figure 2:
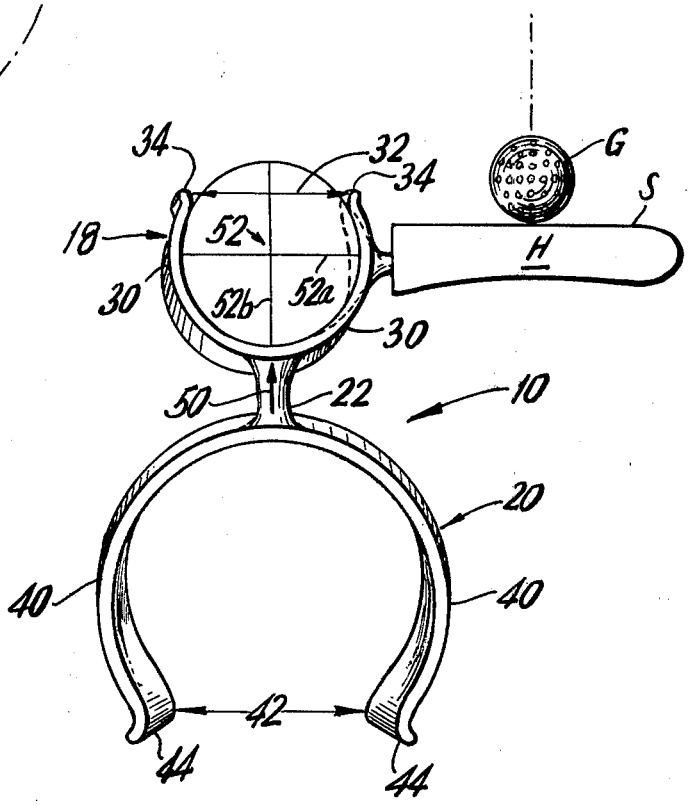
FIG. 2 is an enlarged top plan view of the device in FIG. 1.
Figure 3:
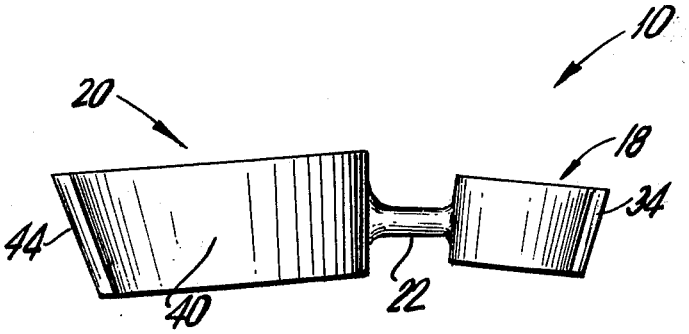
FIG. 3 is an enlarged side view of the device shown in FIG. 2.

Referring to FIGS. 1–3 there is shown the teaching device 10 of the present invention as it is utilized by a golfer. Device 10 is designed for use with a short swing golf club, particularly a putting iron 15 and includes a clamp 18 designed to resiliently clamp onto the grip portion 15*a* of the club adjacent the end thereof. Bracket 18, as shown in the drawings, is in the form of a semicircular clamp having peripheral walls of such an extent as to resiliently grip the golf club and be self-supporting thereon. A forearm portion or clamp 20, which, as shown in the drawings, defines a semicircular positioning member, is spaced on a predetermined distance from bracket 18 by a rigid interconnecting member 22. Portion 20 is designed to resiliently engage the forearm of the golfer's trailing arm T and be self-supporting thereon.

In order to develop a smooth and true stroke the golfer's wrists should not be broken and clubhead must be kept square to the hole or to the line of travel on a rolling green. The teaching device 10 enables the golfer to learn this relationship by triangulation of the forearm T with the club shaft. The triangle defined by points A, B and C thus enables the beginner to assume the proper club relationship yet does not interfere with this grip or natural swing.

Once the golfer has positioned device 10 and grips the club grip with his trailing hand, the forearm portion 20, as will be described in greater detail below, prevents relative movement between the golfer's arm and the device. Thus the distance between points B and C of the triangle are fixed and neither the golfer's trailing arm nor wrists can accidently be "broken" during the back and forward swing.

Device 10 can be formed of a light weight resilient plastic, which can conveniently be produced by molding techniques known in the art. Clamp portion 18 includes wall portions 30 which define a general upwardly tapered, frusto-conical shape zone therebetween which may be slightly undersized relative to the contour of the club grip. The wall portions 30 defines vertical clearance 32 and are flared outwardly at 34 to permit the device to be snap fitted onto the club grip. Once the club grip is inserted into clamp 18 the resilient wall portions 30 acts as cantiliver springs to fully engage and prevent relative movement therebetween.

Forearm portion 20 includes wall portions 40 which define an upwardly tapered and contoured zone approximating the shape of a golfer's arm. Wall portions 40 also define a vertical clearance 42 and have smoothly flared edges 44 to permit the golfer to slip the device onto and off his forearm. Wall portions 40 are resilient and designed to gently hold the golfer's forearm. The interior surfaces of wall portions 40 should be smooth and free of obstructions, such as mold marks and gates so as not to interfere with or irritate the golfer's skin. The wall portions should also be sufficiently resilient to accept the golfer's forearm whether the golfer is wearing a short sleeve shirt or a long sleeve garment such as a jacket or a sweater. In the latter case, it may be advisable to coat the interior surface of wall portions 40 with a non-slip surface to minimize any slippage of the device on the golfer's arm to different coefficients of friction.

Interconnecting member 22, as illustrated, is unitary and thus defines a fixed dimension for triangulation. It will be appreciated, however, that a non-unitary member such as telescoping section may be used to interconnect clamp 18 and forearm portion 20. If a telescoping member is utilized, it should be capable of being locked at a fixed length to provide a fixed, rigid distance.

With particular reference to FIG. 2, interconnecting member 22 is positioned to have a major axis lying in a line joining the center of bracket 18 and forearm portion 20. Furthermore, the vertical axis of the clamp 18 and the forearm portion 20 are each set at an angle to the verticle axis of the device to insure proper triangulation. In the illustrated embodiment the clamp 18 and the forearm portion 20 are each sloped downwardly toward one another at about a five degree angle to the vertical axis of the device 10.

Proper alignment of the putter head H with ball G and the cup (not shown) is another feature achieved with device 10. Putter head H has a planar driving surface which, for proper control of the putt, should be maintained perpendicular to the arc of the golfer's stroke and perpendicular to the desired path of travel of the ball. To this end, the upper surface of interconnecting member 22 includes linear indicia 50, illustrated as an arrow, which lies in line with the center lines of the club bracket and forearm portion. On the top of the club grip 15*a* is an aligning indicia 52, such as a cross hair pattern, which may be in the form of a decal. The golfer applies indicia 52 so that cross hair 52*a* is parallel to driving surface S of the putter head. Indicia 52 thus provides a fixed reference for the golfer, so that when device 10 is used indicia 50 is aligned with cross hair 52*b*. Once the golfer's forearm is inserted in portion 20 and the club is gripped, triangulation at points A, B and C is achieved and the club head is properly oriented to the ball and desired path of the ball to the cup.

Figure 4:
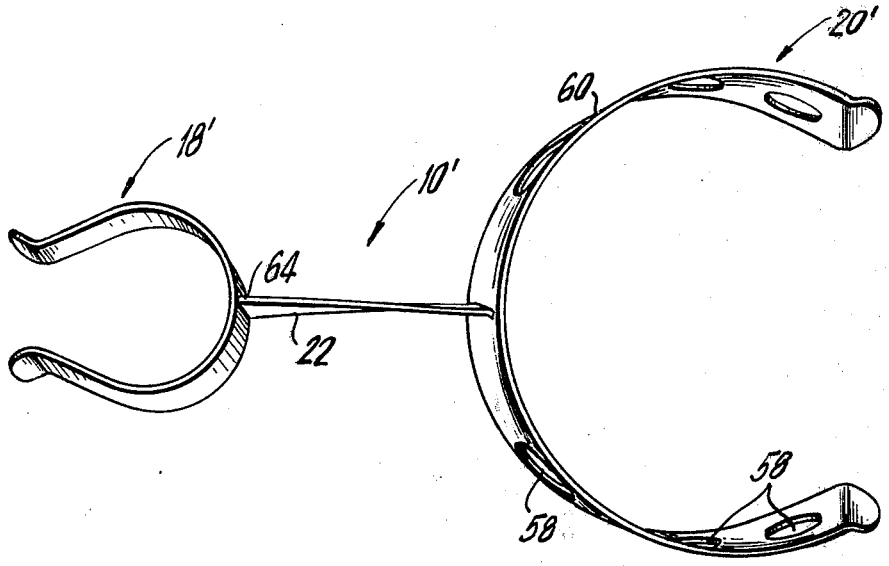
FIG. 4 is an enlarged top plan view of a preferred embodiment of the invention, which is also used as shown in FIG. 1.
Figure 5:
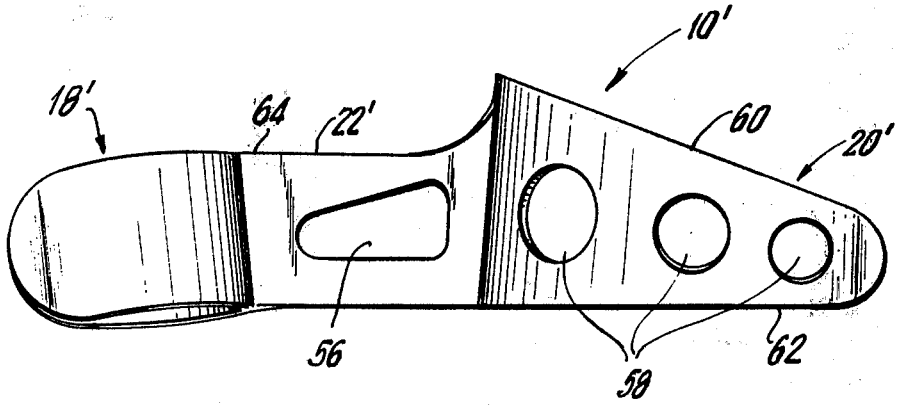
FIG. 5 is an enlarged side view of the device shown in FIG. 4.

Referring to the FIGS. 4 and 5 of the drawings, there is shown a preferred embodiment of the invention, which includes a golf training device 10' formed of spring steel coated with vinyl plastic by known electrostatic methods. In this embodiment the clamp portion 18', interconnecting member 22' and arm portion 20' are formed separately and then welded and heat treated to provide a unitary device 10' with resilient clamp and arm portions. Also, in addition to downwardly sloping the clamp portion 18' and arm portion 20', the clamp 18' is turned inwardly toward the golfer, to further facilitate alignment of the club head H to the ball G. The inward turn of the clamp portion 18' is provided by twisting the interconnecting member 22' as shown in FIG. 4. An inward turn of about 5° has been found to be satisfactory.

To save material and for style, the member 22' has an oblong opening 56 therethrough and a series of holes 58 of increasing diameters are provided in an arm portion 20'. As a further material saving the upper surface 60 of the arm portion 20' is sloped downwardly from the interconnecting member end at an angle of about 20 to 30° while the lower surface 62 is horizontal. In this way the golfer also can readily distinguish between the top and bottom of the device 10' when it is placed on his arm.

Furthermore, in this embodiment the upper surface 64 of the interconnecting member 22' at the golf clamping end itself serves as the indicia for proper alignment of the putter head H to the ball G and cup (not shown).

From the above description, it will be apparent that the present invention provides an extremely useful teaching device for the beginner, as well as the advanced golfer, to learn and practice proper putting techniques without interfering with his normal grip or swing.

What is claimed is:

1. A training device for use with a manually gripped, swing type sporting instrument having a shaft to prevent breaking of the player's wrist and arm so that a predetermined angle between the center line of the shaft and arm is maintained throughout the swing, comprising: a unit having a first portion defining a semicircular clamp having peripheral walls of such an extent as to resiliently clamp said unit to the grip of said shaft so, as to be self supporting thereon, a second portion defining a semicircular positioning member having walls adapted to resiliently engage the forearm portion of a player's arm, and a rigid member between and interconnecting said first and second portions in lateral spaced apart relationship, whereby the center line on a player's arm is maintained at a predetermined angle to the center line of the shaft throughout the swing without the breaking of the player's wrist.

2. The device of claim 1, wherein said rigid member is one piece in structure.

3. The device of claim 1, wherein said first and second member walls define vertical access areas opening in opposite directions.

4. The device of claim 1, including in combination therewith a golf club and said first portion of said device includes upwardly tapered walls adapted to clamp the grip of the club.

5. The device of claim 4, wherein said rigid member includes indicia arranged to be visible to the golfer, and said golf club includes indicia adapted to be aligned with said member indicia, said club indicia being arranged such that alignment of said member and club indicia places the club head perpendicular to the arc of the golfer's stroke.

6. The device of claim 5, wherein the indicia on the device is an arrow and the indicia on said club is a cross hair in which one cross is positioned in alignment with said arrow and there other cross hair is positioned parallel to the stricken surface of the club head.

7. The device of claim 1, wherein said clamp and positioning member are sloped downwardly to facilitate alignment of the club to the ball.

8. The device of claim 7, wherein said clamp is turned inwardly to facilitate the alignment of the club to the ball.

9. The device of claim 7 wherein the downward slope for said positioning member and clamp is about five degrees from the vertical axis of the device and the inward turn of said clamp is about five degrees.

10. The device of claim 8, wherein the upper surface of said positioning member is sloped downwardly and the lower surface thereof is horizontal so that the user can readily tell which is the top and bottom of said device.

11. A golf training device which facilitates alignment of the club to the ball and prevents breaking of the player's trailing wrist in putting and on short swings by maintaining a predetermined angle between the center line of the golf shaft and trailing arm throughout the swing, comprising: a unit having a semicircular clamp having peripheral walls of such an extent as to resiliently clamp said unit to the grip of the shaft adjacent the end of the club so as to be self-supporting thereon, a semicircular bracket having peripheral walls of such an extent as to resiliently engage such unit to the forearm portion of a player's arm so as to be self-supporting thereon, and a rigid member between and interconnecting said clamp and bracket, said clamp and bracket are sloped downwardly from said rigid member to facilitate alignment of the club to the ball, said unit maintaining the center line on a player's trailing arm at a predetermined angle to the center line of the shaft throughout the swing without breaking of the player's trailing wrist.

12. The golf device of claim 11 wherein said device includes indicia on said unit and indicia for placement on the top of the grip of the golf club, said indicia on said unit being on said rigid interconnecting member of said unit and being arranged thereon to be visible to the golfer, and said indicia for placement on the top of the golf club also being arranged to be visible to the golfer when placed on the club to allow the golfer to properly align said indicia on said unit and golf club so that the club head of the golf club can be placed in the proper arc to the golfer's stroke.

* * * * *